US012404855B2

(12) United States Patent
Krumm et al.

(10) Patent No.: US 12,404,855 B2
(45) Date of Patent: Sep. 2, 2025

(54) COOLING SYSTEM FOR A HYDROGEN COMPRESSOR

(71) Applicant: NUOVO PIGNONE TECNOLOGIE—SRL, Florence (IT)

(72) Inventors: Robert Krumm, Oklahoma City, OK (US); Vinh Do, Oklahoma City, OK (US); Simone Bassani, Florence (IT)

(73) Assignee: Nuovo Pignone Tecnologie—SRL, Florence (IT)

( * ) Notice: Subject to any disclaimer, the term of this patent is extended or adjusted under 35 U.S.C. 154(b) by 44 days.

(21) Appl. No.: 18/279,739

(22) PCT Filed: Mar. 4, 2022

(86) PCT No.: PCT/EP2022/025079
§ 371 (c)(1),
(2) Date: Sep. 1, 2023

(87) PCT Pub. No.: WO2022/184323
PCT Pub. Date: Sep. 9, 2022

(65) Prior Publication Data

US 2024/0151222 A1 May 9, 2024

(30) Foreign Application Priority Data

Mar. 5, 2021 (IT) ..... 102021000005168

(51) Int. Cl.
*F04B 53/02* (2006.01)
*F04B 53/08* (2006.01)
*F04B 53/14* (2006.01)

(52) U.S. Cl.
CPC ..... *F04B 53/02* (2013.01); *F04B 53/08* (2013.01); *F04B 53/144* (2013.01)

(58) Field of Classification Search
CPC ..... F04B 39/062; F04B 39/064; F04B 53/02; F04B 53/08; F04B 53/164
See application file for complete search history.

(56) References Cited

U.S. PATENT DOCUMENTS 3,147,982 A * 9/1964 Klein ..... F16J 15/162 277/930
3,544,118 A * 12/1970 Klein ..... F16J 15/006 277/927
5,873,575 A 2/1999 Hanlon
6,932,351 B1 * 8/2005 Mowll ..... F04B 39/0022 277/517

(Continued)

FOREIGN PATENT DOCUMENTS

EP 3628867 A1 4/2020
EP 3653911 A1 5/2020

*Primary Examiner* — Michael Leslie
(74) *Attorney, Agent, or Firm* — Paul Frank + Collins P.C.

(57) ABSTRACT

A hydrogen cooled pressure packer, systems, and methods of operation are provided. The pressure packer can include a flange portion and a plurality of packing cups coupled to the flange portion. One or more packing cups of the plurality of packing cups include at least one injection channel extending therethrough and terminating in at least one injection port. The pressure packer can also include a seal abutted with at least one packing cup of the plurality of packing cups. The pressure packer can be configured for use in a hydrogen compressor operable within a hydrogen vehicle refueling facility.

20 Claims, 3 Drawing Sheets

(56) References Cited

U.S. PATENT DOCUMENTS

| | | | | |
|---|---|---|---|---|
| 7,563,078 | B2 * | 7/2009 | Miura | F04B 27/02 417/268 |
| 8,366,114 | B1 * | 2/2013 | Gruner | F28F 9/00 277/510 |
| 10,273,952 | B2 | 4/2019 | Trevino et al. | |
| 11,788,541 | B2 * | 10/2023 | Kvachnev | F04D 29/124 277/361 |
| 12,092,216 | B2 * | 9/2024 | Orsi | F16J 15/162 |

* cited by examiner

COOLING SYSTEM FOR A HYDROGEN COMPRESSOR

BACKGROUND

Compressors are mechanical devices which are commonly used in a variety of domains including oil and gas production, industrial heating and cooling, and manufacture of chemicals and/or fuels. Compressors can be used in fuel production to compress hydrogen gas for transport and distribution as a compressed hydrogen gas fuel. Heat generated during gas compression must be mitigated to protect the compressor components from failure, to maintain safe operating conditions in the fuel production environment, and to ensure that desired fuel production rates are achieved. Heat mitigation is an important aspect of compressor design and operation for hydrogen fuel production.

SUMMARY

Fueling vehicles using compressed hydrogen can be challenging due to the pressure (bar) and the flow rates (kg/hr) required. For example, a large, heavy-duty vehicle can require compressed hydrogen to be provided to a fuel cell of the vehicle at 800-900 bar and 800-1200 kg/hr. Conventional compressors are unable to meet these requirements due to limitations mitigating heat within particular components of the compressors, such as seals. Seals used to surround and protect a piston rod of the compressor can become damaged by heat generated during compression of hydrogen gas.

Dynamic sealing elements within a pressure packer of a reciprocating compressor can be vulnerable to damage and failure due to excess, unmitigated heat. Excess heat, which is a function of sealing pressure, causes accelerated degradation on sealing surfaces reducing the useful life of sealing components. Traditional cooling systems, such as fluid or water-based cooling systems, can be used to reduce heat damage on compressor components. However, the use of fluid or water-based cooling systems can contaminate the hydrogen being compressed. In addition, the cooling channels of these systems can provide fluidic pathways by which the hydrogen being compressed can escape from the components of the compressor.

A need exists for a cooling system for compressors and compressor components which will not alter or contaminate the gas being compressed. In addition, there is a need for a cooling system which can contain the gas being compressed within the cooling system so as not to allow gas to escape via the cooling system.

A cooling system is described herein addressing such limitations. The compressor cooling system includes a pressure packer that can receive and circulate compressed cooled hydrogen via one or more injection channels configured in the pressure packer. Compressed hydrogen gas can be distributed within the injection channels into fluidic interface with heated portions of the compressor, such as a reciprocating piston rod, and can absorb heat from the reciprocating piston rod. Portions of the pressure packer, such as pressure packing cups, which can contain the injection channels, can be formed using additive manufacturing techniques so that more intricate formations of the injection channels can be formed to improve heat transfer surface area and interfaces. An advantage of using hydrogen for cooling is its low viscosity compared to water and other liquid coolants, this allows for more intricate flow channels and "turbulent trips" further improving heat transfer. Cooled hydrogen gas provided within the injection channels of the pressure packer can absorb heat from portions of the compressors, such as the reciprocating piston rod. The hydrogen gas can absorb the heat and heat laden hydrogen gas can be removed from the pressure pack and the compressor via one or more vents correspondingly configured with respect to the one or more injection channels. The vents can be coupled via fluidic circuits to cooling systems, such as one or more chillers, where the heat laden hydrogen gas can be cooled and recirculated back to the feed stream of the compressor. In this way, heat transfer can be improved due to the increased surface area of the injection channels and cross contamination between the cooling system fluids and the gas being compressed is eliminated.

In general, apparatuses, systems, and methods of operation are provided for cooling a pressure packer of a hydrogen compressor. In one aspect, a pressure packer is provided. In one embodiment, the pressure packer can include a flange portion and a plurality of packing cups coupled to the flange portion. One or more packing cups of the plurality of packing cups can include at least one injection channel extending therethrough and terminating in at least one injection port. The pressure packer can also include a seal abutted with at least one packing cup of the plurality of packing cups.

In another embodiment, the pressure packer can include at least one vent port in fluidic communication with at least one vent extending through the plurality of packing cups. In another embodiment, the plurality of packing cups and the at least one injection channel are formed using additive manufacturing techniques. In another embodiment, the injection channel receives a hydrogen gas to cool the pressure packer. In another embedment, the pressure packer surrounds a piston rod of a hydrogen compressor in which the pressure packer is operable.

In another aspect, a system for producing compressed hydrogen fuel for a hydrogen fuel vehicle is provided. In one embodiment, the system can include a hydrogen compressor including a pressure packer. The pressure packer can include a flange portion and a plurality of packing cups coupled to the flange portion. One or more of the plurality of packing cups can include at least one injection channel extending therethrough and terminating in at least one injection port. The pressure packer can also include at least one vent port in fluidic communication with at least one vent extending through the plurality of packing cups. The system can also include a cold box and a plurality of fluidic circuits coupling the at least one vent of the pressure packer to the cold box.

The cold box is a commonly deployed device used in hydrogen fueling stations to cool hydrogen delivered to the filling vehicle. The cold box uses refrigeration to cool hydrogen. The purpose of the cold box is that of increasing the density of the hydrogen by reducing its temperature thereby increasing storage density per unit volume. A portion of the cooled hydrogen can be diverted from cold box and circulated through the packer cup cooling system thereby eliminating the need for a separate refrigeration system for the compressor.

In another embodiment, the plurality of fluidic circuits can be configured to convey heated hydrogen gas from the at least one vent to the cold box and to further convey chilled hydrogen gas to the at least injection channel to cool the pressure packer. In another embodiment, the system can be configured in a vehicle fueling facility configured to generate and distribute compressed hydrogen gas a fuel for the hydrogen fuel vehicle. In another embodiment, the system can distribute the compressed hydrogen as a fuel at a rate of 400-500 kg/hr and at 850-900 bar.

DESCRIPTION OF DRAWINGS

These and other features will be more readily understood from the following detailed description taken in conjunction with the accompanying drawings, in which.

Figure 1:
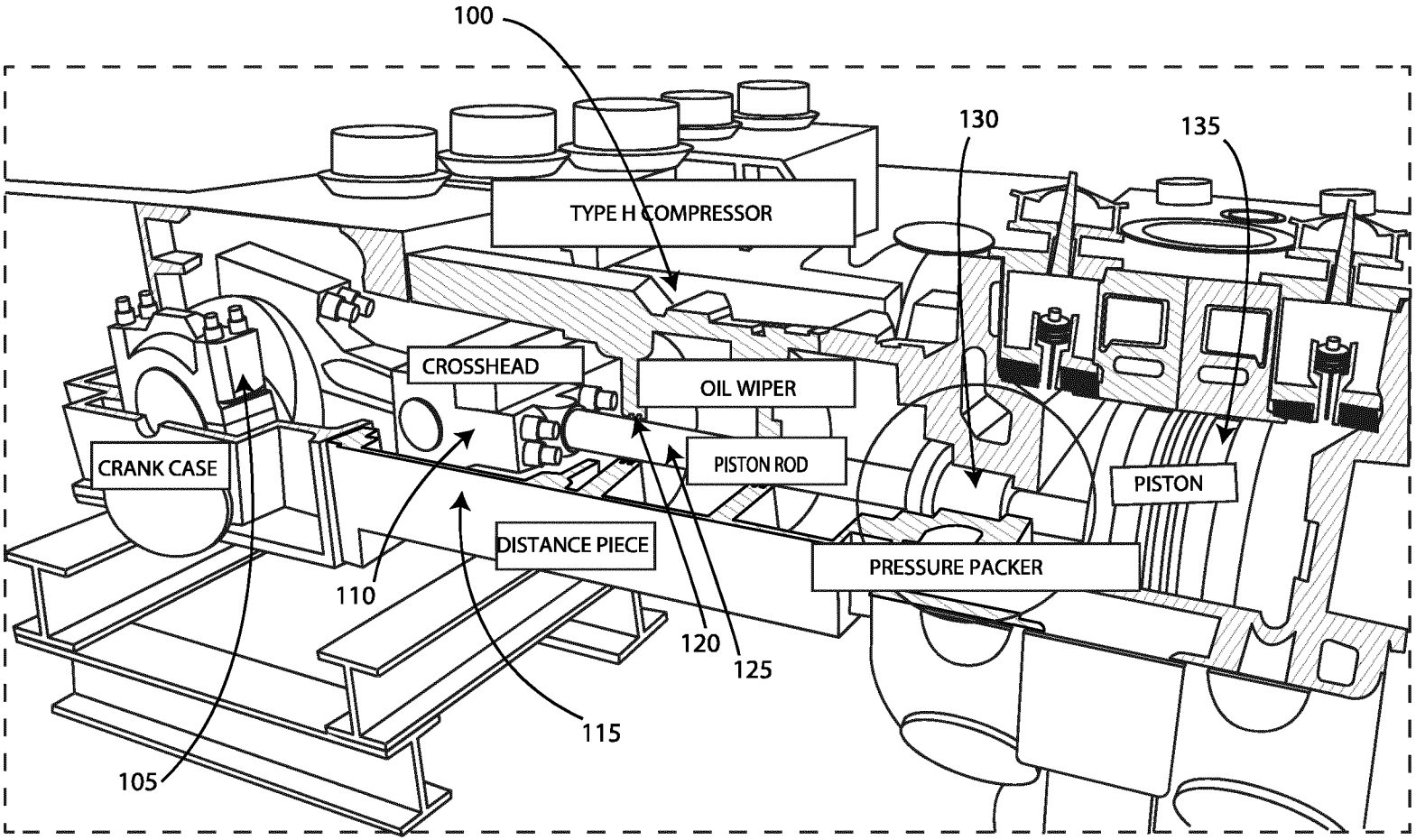
FIG. 1 is an image showing one example embodiment of a compressor for compressing hydrogen gas according to implementations described herein.

It is noted that the drawings are not necessarily to scale. The drawings are intended to depict only typical aspects of the subject matter disclosed herein, and therefore should not be considered as limiting the scope of the disclosure.

DETAILED DESCRIPTION

Reciprocating compressors for hydrogen used in petroleum refineries can supply the flow rate but are pressure limited around 100 bar. Diaphragm compressors are common in hydrogen fueling pilot stations and can reach pressures up to 1000 bar but are unable to supply flow rates of 500 kg/hr or greater. High-capacity diaphragm pumps can supply hydrogen up to 150 kg/hr, but are the size of shipping containers making their use limited in configurations having multiple pumps.

Advancements in electrochemical hydrogen compressors use proton exchange membranes and electricity to force hydrogen across a barrier to higher pressures. Electrochemical compression is challenged by the cost of the materials required, low power density, and large electrical overpotentials. Thermally driven compression using metal hydrides or absorption is another option, but requires large equipment and provides poor efficiency. Mechanical compression, specifically multi-stage reciprocating pistons, is the most capable example with hyper-compressors being able to deliver pressures exceeding 3,000 bar.

Hydrogen embrittlement, compression speed, and seals are some of the largest concerns when designing and operating hydrogen compressors. Engineering guidelines for reciprocating compressors are outlined in ANSI/API standard 618. Because of the dry sealing requirement and hydrogen environment, the maximum temperature in the pressure packing case is limited to 135° C. The pressure packing contains a series of sealing glands that prevent leakage of gas between the cylinder bore and the piston rod.

Compressors, such as reciprocating compressors, used to compress gas generate heat which must be dissipated or mitigated to protect the compressor from damage. High pressure hydrogen compression generates considerable heat which can cause excess wear on components of the compressor, such as the sealing elements of a pressure packer configured in the compressor. When compressing hydrogen gas, it can be advantageous to use the hydrogen gas in a cooling system coupled to the compressor to avoid contamination between cooling system gases or fluids and process gases being formed using the compressor.

As mentioned cold box is a piece of equipment commonly used in hydrogen fueling stations to reduce the delivery temperature of the hydrogen to −40° C. to the vehicle. This existing piece of equipment can be used to chill hydrogen that is used to cool compressor components. The advantages of using chilled hydrogen for cooling the pressure packer include hydrogen's high heat capacity (14.5 kJ/kg*K at 135° C.), low pressure drop, and eliminating the risk of contamination from leaks. Hydrogen's thermodynamic properties make it ideally suited for heat transfer in compressor cooling systems compared to water or helium, for example. Water can contribute to cross-contamination of the hydrogen gas being compressed and helium is cost prohibitive. Hydrogen has three times the heat capacity of water on a per weight basis and approximately one third of the thermal conductivity of water. Hydrogen also has a lower viscosity than water, e.g., 0.01 cP for Hydrogen at 875 bar and 135° C. compared to 0.2 cP for water at 135° C. As a result, the cooling system described herein can provide greater cooling for a pressure packer of a compressor since the lower viscosity of Hydrogen allows more of it to be used for cooling. Thus, precision engineered cooling channels produced within the pressure packer, which may use additive manufacturing techniques, can maintain temperature limits without exceeding the America Petroleum Institute's (API) maximum recommended pressure drop of 1.7 bar for reciprocating compressors. In the embodiment at issue, the cold box is a cooling circuit. Each individual cooling circuits is used to maintain differential pressured between sealing elements. Also engineered geometries are optimized to improve heat transfer rates.

The cooling system described herein includes a pressure packer of a reciprocating hydrogen compressor with a plurality of injection channels through which hydrogen gas can be distributed. The portions of the pressure packer which include the injection channels can be formed using additive manufacturing techniques to produce a more intricate channel configuration than could be formed using traditional piping and fluid conduits and thereby increasing the heat transfer capabilities of the cooling system. When coupled with an external cooling source, such as a cold box at a hydrogen vehicle refueling station, cooled hydrogen can be provided to the pressure packer from the cold box to absorb heat generated by the compressor and/or the pressure packer. The heated hydrogen gas can then be returned to the cold box for cooling via one or more vents configured in the pressure packer and coupled to one or more fluidic circuits. The fluidic circuits can convey the heated hydrogen gas to the cold box where the heat can be removed and fresh, cold hydrogen gas can be recirculated back the injection channels of the pressure packer.

Embodiments of the present disclosure describe an apparatus, system, and method for cooling a pressure packer of a hydrogen compressor using hydrogen gas in a hydrogen vehicle fueling environment. However, it can be understood that embodiments of the disclosure can be employed for cooling other compressor components configured in an environment other than a hydrogen vehicle fueling environment without limit.

FIG. 1 is an image showing one example embodiment of a compressor 100 for compressing hydrogen gas according to implementations described herein. The compressor 100 can be a reciprocating compressor configured to compress a hydrogen feed stream input and to output a compressed hydrogen gas. As shown in FIG. 1, the compressor 100 can include a crank case 105. The crank case 105 can be coupled to a crosshead 110 configured in a distance piece 115. The distance piece 115 can further include an oil wiper 120 and a piston rod 125. The piston rod 125 can be coupled to the crank case 105 via the cross head 110 such that rotation of the crank case 105 causes the piston rod 125 to drive forward and retract backwards. The piston rod 125 can extend through a pressure packer 130 to couple with the piston 130. As the piston rod 125 is driven forward and retracted backward through the pressure packer 130, heat is generated. If not dissipated or mitigated, the heat generated by movement of the piston rod 125 through the pressure packer 130 and its sealing components can cause damage to the seals of the pressure packer 130, the pressure packer 130 itself, and/or the compressor 100.

Figure 2:
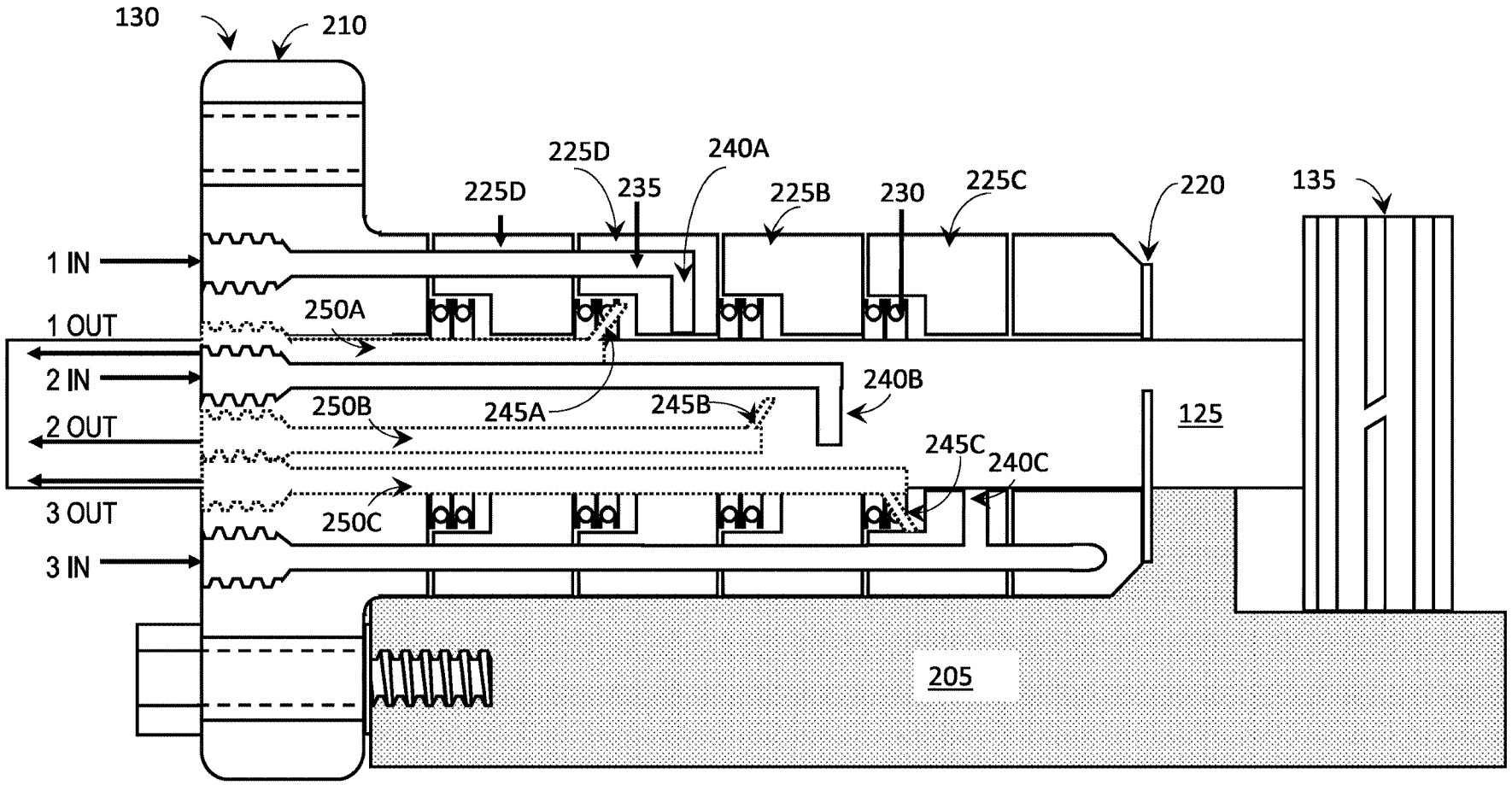
FIG. 2 is a diagram illustrating a side view of one example embodiment of a pressure packer of the compressor of FIG. 1 according to implementations described herein.

FIG. 2 is a diagram illustrating a side view of one example embodiment of a pressure packer 130 of the compressor 100 of FIG. 1 according to implementations described herein. As shown in FIG. 2, the pressure packer 130 can be coupled to a cylinder body 205 of the compressor. The pressure packer 130 can include a flange 210 through which bolts 215 can secure the pressure packer 130 to the cylinder body 205. The piston rod 125 of the compressor 100 can extend through the pressure packer 130 and can be surrounded by a seal 220. As the piston rod 125 travels within the seal 220 to drive the piston 135 forward and backward, heat can be generated at the seal 220. Excessive heat can cause the seal 220 to fail and damage the pressure packer 130 and/or the compressor 100. In some embodiments, ionic liquid lubricants can be utilized to lubricate portions of the pressure packer 130 to assist with wear reduction and in conjunction with the pressure packer cooling system described herein to minimize heat generation. Ionic liquid lubricants are advantageous because they will not dissolve in hydrogen gas like hydrocarbon-based lubricants, can be easily filtered out of the compressed hydrogen gas that is outputted from the compressor 100. Additionally, ionic liquids can be used as lubricants because of their beneficial properties including inflammability, non-volatility, and high thermal stability.

As further shown in FIG. 2, the pressure packer 130 includes one or more packing cups surrounding the piston rod 125, which can be collectively referred to as packing cups 225. Four packing cups are shown in FIG. 2, for example, the packing cups 225A, 225B, 225C, and 225D. One or more of the packing cups 225 can include a pair of packing rings 230 as shown in the packing cups 225A, 225B, and 225D. The packing rings, collectively referred to as packing rings 225, can reduce friction at the interface of the piston rod 125 and the surface of the packing cup 225 facing the piston rod 125.

An injection channel 235 is configured to extend through the packing cups 225 and into fluid interface with the piston rod 125. Although FIG. 2 shows a single injection channel 235 configured in the pressure packer 130, additional injection channels may also be configured such that the pressure packer 130 includes one or more injection channels 235. The injection channel can be bifurcated to correspond to the number of packing cups 225. The injection channel 235 can include one or more injection ports, for example injection ports 240A, 240B, and 240C, which can be collectively referred to as injection ports 240. Cooled hydrogen gas, for example hydrogen gas cooled to −40° C., can be received from a source (also known as the cold box) and provided into the pressure packer 130 via the injection channel 235 and the injection ports 240.

Heat that is generated by the reciprocating piston rod 125 can be absorbed by the hydrogen gas and conveyed away from the reciprocating piston rod 125 via one or more vents ports 245. For example, as shown in FIG. 2, the pressure packer 130 includes three vents ports 245 (e.g., vent ports 245A, 245B, and 245C) each of which is configured in correspondence with the three injection ports 240A, 240B, and 240C in a particular packing cup 225. In some embodiments, a packing cup 225 can include one or more injection port 240, vent port 245 pair(s). In some embodiments, the number and configuration of injection ports 240 may not correspond to the number and configuration of the vent ports 245. Any number or configuration of injection ports 240 and vent ports 245 can be provided in the pressure packer 130 without limitation.

The vent ports 245 can be coupled to corresponding vents 250. For example, vent port 245A can fluidically convey the heated hydrogen gas to vent 250A. The pressure packer 130 and the packing cups 225 can include a non-limiting number and configuration of vent ports 245 and vents 250 without limitation. The vents 250 can be coupled to a cold source, such as a cold box, via one or more fluidic circuits configured to convey the heated hydrogen gas to the cold box for thermal recycling. In some embodiments, the vents 250 and the fluidic circuits can be configured in a cascading arrangement.

Additive manufacturing techniques can be used to form the packing cups 225, the injection channels 235, the injection ports 240, the vent ports 245, and/or the vents 250.

Figure 3:
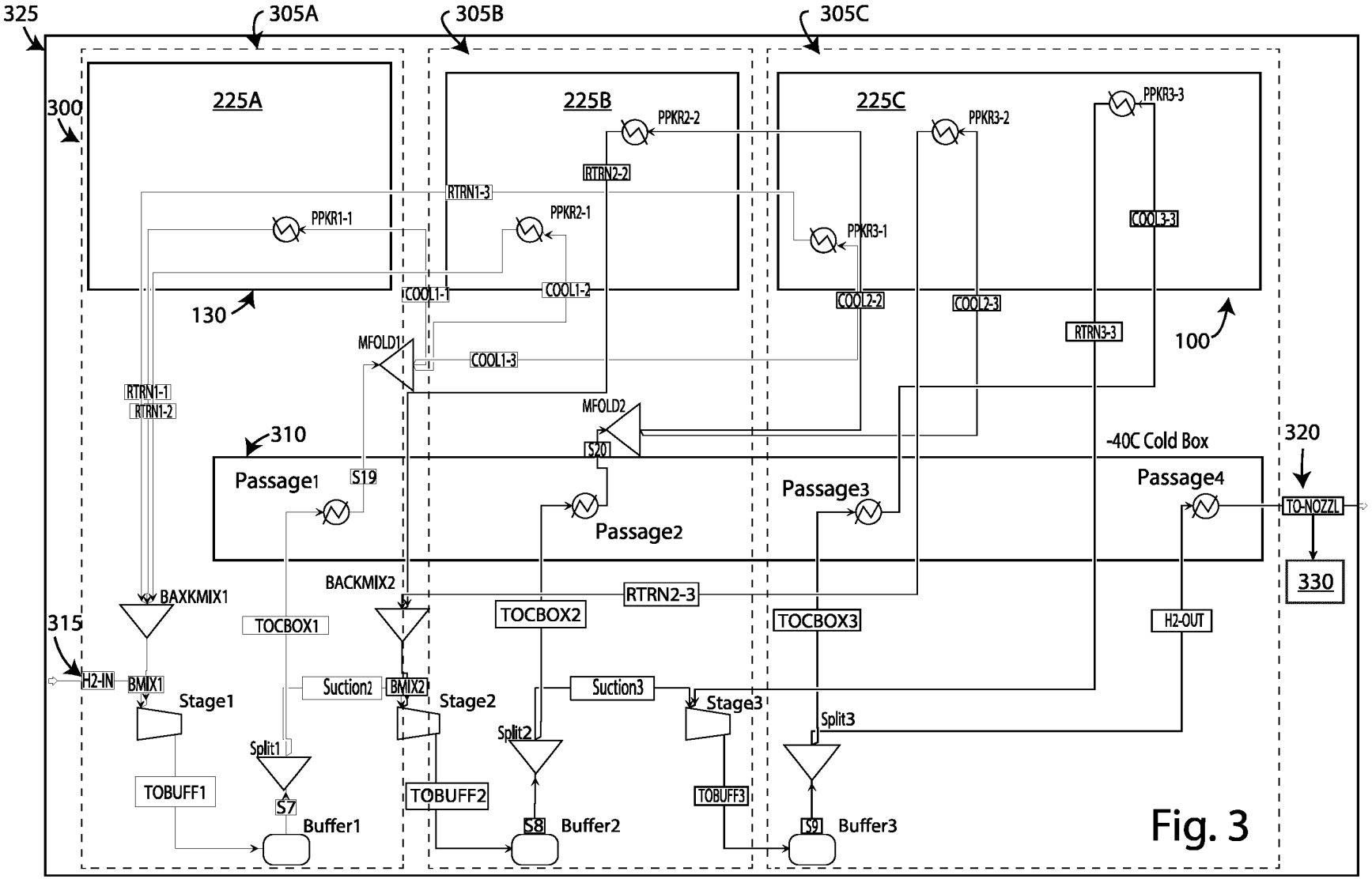
FIG. 3 is a diagram illustrating one example embodiment of a system for cooling the pressure packer of FIG. 2 according to implementations described herein.

FIG. 3 is a diagram illustrating one example embodiment of a system 300 for cooling the pressure packer 130 of FIG. 2 according to implementations described herein. As shown in FIG. 3, a fluidic circuit 305 can be configured to correspond to and/or be in fluid communication with the vent 250 associated with a particular packing cup 225. Three fluidic circuits 305 are shown in FIG. 3 (e.g., fluidic circuits 305A, 305B, and 305C). Each fluidic circuit 305 can be coupled to a cold source, such as cold box 310. The cold box 310 can receive a hydrogen feedstock 315 and can cool the feedstock to produce a chilled hydrogen process stream 320. In some embodiments, the system 300 can be configured in a vehicle fueling environment or facility 325, such as an environment or facility configured to fuel or refuel vehicles 330 using compressed hydrogen. The vehicles 330 can include heavy duty vehicles such as Class 8 tractor trailers, forklifts, refrigerated shipping containers, rail cars, or trucks. The system 300 can be configured to deliver the chilled hydrogen process stream 320 as a compressed hydrogen vehicle fuel at a flow rate between 400 and 600 kg/hr at a pressure between 500 and 900 bar with minimal contamination. In some embodiments, the system 300 can deliver the chilled hydrogen process stream 320 as a compressed hydrogen vehicle fuel at a flow of 500 kg/hr and at a pressure of 875 bar. Different pressures of chilled hydrogen coming from different stages of the compressor can be used in a cascade cooling configuration with higher pressure hydrogen cooling outboard (piston side) and lower pressure cooling inboard. The advantage of cascade cooling is that it enables more control over how much heat is removed and the differential pressure between sealing elements.

An advantage of the solution is that it takes advantage the thermophysical properties of hydrogen for cooling and would not work with most other gases. In addition to hydrogen, also helium is a gas that could be used.

Another advantage of the solution is that it can be applied to all packing cups and work with segmented seals, potentially preventing wear on all seals.

It is another advantage of the invention is that it injects bypass hydrogen to maintain the differential pressure. The prior art uses controlled venting. In addition, the injected hydrogen can also be used for cooling and maintaining a pressure differential across a seal.

Exemplary technical effects of the apparatuses, systems, and methods described herein include, by way of non-limiting example, improved cooling of a pressure packer of a hydrogen compressor. The pressure packer can be formed using additive manufacturing techniques to form injection channels and vents which can more thoroughly interface with heat generating portions of the compressor and more efficiently conduct heat transfer to maintain safe operation of the compressor. The pressure packer can be cooled via a hydrogen gas supply, which can reduce cross-contamination with process gases and increase the heat transfer capabilities compared to existing water-cooled cooling systems. The cooling system described herein can be configured in a hydrogen vehicle fueling environment or facility and can be coupled to a cold box therein to receive a hydrogen gas supply via one or more cascaded fluidic circuits for cooling the pressure packer.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A pressure packer, comprising:
- a flange portion forming a first end of said pressure packer;
- a seal spaced apart from the flange and forming a second end of said pressure packer; and
- packing cups disposed between the flange portion and the seal, the packing cups comprising,
  - a first packing cup adjacent the flange portion, and
  - a second packing cup adjacent the seal,
- wherein one or more of the packing cups has an injection channel extending therethrough, the injection channel terminating at an injection port.

2. The pressure packer of claim 1, further comprising:
- at least one vent extending through the packing cups.

3. The pressure packer of claim 1, wherein the packing cups and the injection channel are formed using additive manufacturing techniques.

4. The pressure packer of claim 1, wherein the injection channel is configured to receive a hydrogen gas to cool the pressure packer.

5. The pressure packer of claim 1, wherein the flange portion, the seal, and the packing cups are configured to surround a piston rod of a hydrogen compressor.

6. The pressure packer of claim 1, further comprising:
- at least one vent extending through the packing cups,
- wherein the injection channel terminates at a vent port in fluidic communication with the at least one vent.

7. A system for producing compressed hydrogen fuel for a hydrogen fuel vehicle, the system comprising:
- a hydrogen compressor including a pressure packer, the pressure packer comprising:
  - a flange portion forming a first end of the pressure packer;
  - a seal spaced apart from the flange and forming a second end of the pressure packer; and
- packing cups disposed between the flange portion and the seal, the packing cups comprising,
  - a first packing cup adjacent the flange portion, and
  - a second packing cup adjacent the seal,
- wherein one or more of the packing cups has an injection channel extending therethrough, the injection channel terminating at an injection port;
- at least one vent extending through the plurality of packing cups, wherein the injection channel terminates at a vent port in fluidic communication with the at least one vent;
- a cooling circuit comprising a cold box and fluidic circuits coupling the cold box to the at least one vent.

8. The system of claim 7, wherein the fluidic circuits are configured to convey heated hydrogen gas from the at least one vent to the cooling circuit and to convey chilled hydrogen gas to the injection channel to cool the pressure packer.

9. A vehicle fueling facility configured to generate and distribute compressed hydrogen gas as a fuel for a hydrogen fuel vehicle, the vehicle fueling facility comprising the system of claim 7.

10. The vehicle fueling facility of claim 9, wherein the system distributes the fuel at a rate of 400-500 kg/hr and at 850-900 bar.

11. The system of claim 7, wherein the flange portion of the pressure packer secures to a cylinder body on the hydrogen compressor.

12. The system of claim 7, further comprising:
- bolts that extend through the flange portion of the pressure packer into a cylinder body on the hydrogen compressor.

13. A hydrogen compressor, comprising:
- a cylinder body;
- a piston disposed in the cylinder body; and
- a pressure packer attached to the cylinder body, the pressure packer comprising:
  - a flange portion;
  - a seal spaced apart from the flange portion;
  - packing cups disposed between the flange portion and the seal; and injection channels and vents extending through the flange portion and the packing cups; and a fluid circuit coupled to the vents.

14. The hydrogen compressor of claim 13, further comprising:

a cold box coupled to the fluid circuit.

15. The hydrogen compressor of claim 13, wherein the injection channels terminate at an opening in the flange portion.

16. The hydrogen compressor of claim 13, wherein the vents terminate at an opening in the flange portion.

17. The hydrogen compressor of claim 13, wherein the injection channels terminate at an opening in the packing cups proximate the piston.

18. The hydrogen compressor of claim 13, wherein the vents terminate at an opening in the packing cups proximate the piston.

19. The hydrogen compressor of claim 13, wherein the pressure packer comprises packing rings disposed between the packing cups and the piston.

20. A vehicle fueling facility configured to generate and distribute compressed hydrogen gas as a fuel for a hydrogen fuel vehicle, the vehicle fueling facility comprising the hydrogen compressor of claim 13.

* * * * *